US007244885B2

(12) United States Patent
Kageyama

(10) Patent No.: US 7,244,885 B2
(45) Date of Patent: Jul. 17, 2007

(54) SERVER APPARATUS STREAMING MUSICAL COMPOSITION DATA MATCHING PERFORMANCE SKILL OF USER

(75) Inventor: Tomoyuki Kageyama, Tokyo (JP)

(73) Assignee: Yamaha Corporation, Hamamatsu-shi (JP)

( * ) Notice: Subject to any disclaimer, the term of this patent is extended or adjusted under 35 U.S.C. 154(b) by 155 days.

(21) Appl. No.: 11/110,127

(22) Filed: Apr. 19, 2005

(65) Prior Publication Data

US 2005/0235809 A1 Oct. 27, 2005

(30) Foreign Application Priority Data

Apr. 21, 2004 (JP) ..... 2004-125059

(51) Int. Cl.
*G10H 7/00* (2006.01)

(52) U.S. Cl. ..... 84/645; 84/601; 84/609; 84/615; 84/649; 84/653

(58) Field of Classification Search ..... None
See application file for complete search history.

(56) References Cited

U.S. PATENT DOCUMENTS

2005/0120865 A1* 6/2005 Tada ..... 84/600
2005/0120866 A1* 6/2005 Brinkman et al. ..... 84/609
2005/0155484 A1* 7/2005 Yanase et al. ..... 84/615

FOREIGN PATENT DOCUMENTS

JP 2002-341864 11/2002

* cited by examiner

*Primary Examiner*—Marlon Fletcher
(74) *Attorney, Agent, or Firm*—Morrison & Foerster LLP

(57) ABSTRACT

In a server apparatus, a storage section stores musical composition data representing a plurality of musical compositions. A transmission section transmits musical composition data which represents a first musical composition to an electronic musical apparatus via a communication network in a streaming manner, such that the electronic musical apparatus can reproduce the first musical composition in realtime basis. A reception section receives operation data from the electronic musical apparatus, the operation data representing a user operation of the electronic musical apparatus performed in response to realtime reproduction of the first musical composition. A control section selects musical composition data representing a second musical composition based on contents of the operation data, such that the second musical composition matches a skill of the user to operate the electronic musical apparatus, and controls the transmission section to transmit the selected musical composition data of the second musical composition to the electronic musical apparatus in the streaming manner, whereby another user operation can be performed in response to the realtime reproduction of the second musical composition.

6 Claims, 8 Drawing Sheets

FIG. 4

| EVALUATION GRADE | MUSICAL PERFORMANCE SKILL EVALUATION POINT (ASSUMING 100 POINTS TO BE A PERFECT SCORE) | MUSICAL COMPOSITION |
|---|---|---|
| A | 80-100 | MUSICAL COMPOSITIONS Al-An |
| B | 60-79 | MUSICAL COMPOSITIONS Bl-Bm |
| C | 40-59 | MUSICAL COMPOSITIONS Cl-Co |
| D | 20-39 | MUSICAL COMPOSITIONS Dl-Dp |
| E | 0-19 | MUSICAL COMPOSITIONS El-Eq |

※ SUFFIXES n, m, o, p, q, AND p ATTACHED TO MUSICAL COMPOSITION REFERENCE SYMBOLS ARE NATURAL NUMBERS. THE SUFFIXES REPRESENT MUSICAL COMPOSITION NUMBERS GIVEN TO MUSICAL COMPOSITIONS BELONGING TO EACH EVALUATION GRADE. VALUES OF THESE NUMBERS APPROXIMATELY RANGE FROM 10 TO 100.

SERVER APPARATUS STREAMING MUSICAL COMPOSITION DATA MATCHING PERFORMANCE SKILL OF USER

BACKGROUND OF THE INVENTION

1. Technical Field

The present invention relates to a musical composition provision system capable of musical lessons and games by streaming musical composition data to electronic musical apparatuses such as electronic musical instruments from a server apparatus via a communication network such as the Internet.

2. Related Art

Conventionally, there are known systems that provide musical composition data to terminal equipment such as electronic musical instruments from a server apparatus via a communication network such as the Internet. For example, in the system described in a patent document of Japanese Patent Unexamined Publication No. 2002-341864, the server apparatus streams musical composition data to the terminal equipment. The terminal equipment is configured to be capable of automatic play based on the streamed musical composition data.

Data is successively transmitted and received in units of packets via communication networks such as the Internet. When the communication is congested, the transmission is often interrupted. Accordingly, during realtime reproduction of musical composition data streamed in the terminal equipment, the musical composition data to be reproduced is interrupted. As a result, the reproduction is often interrupted. To solve this problem, the system disclosed in the patent document stores the specified amount of streamed musical composition data in buffer memory and then starts the reproduction. Depending on communication situations, however, data reception may be interrupted to affect the automatic play.

On the other hand, there are musical composition data delivery services such as "Net de He Ciao" (registered trademark) provided by YAMAHA CORPORATION. According to this system, a personal computer (PC) is used to download musical composition data from a server. The downloaded data is stored in the PC or electronic musical instrument. Capabilities of PC software sequencer and the electronic musical instrument can be used to automatically play music or display a musical score. Alternatively, an electronic musical instrument's user can play the music in synchronization with such reproduction operations, and grade or evaluate his or her performance skill.

Since the system uses the downloaded and purchased musical composition data, a high royalty is needed, which increases the price of the musical composition data. When the musical composition data is used, the PC and the electronic musical instrument may grade or evaluate the performance skill of the user independently of the server apparatus. Consequently, the user needs to search or select a musical composition to be purchased and performed next based on his or her own judgement.

To solve this problem, there is a demand for a service capable of streaming musical composition data from a server apparatus to electronic musical apparatus such as an electronic musical instrument, enabling musical performance operation in synchronization with the streamed musical composition data, and enabling properly and effectively performing musical lessons and games.

SUMMARY OF THE INVENTION

The present invention has been made in consideration of the foregoing. It is therefore an object of the present invention to provide a musical composition provision system capable of smoothly using streamed musical composition data for a user to control musical performance operation, evaluating the musical performance operation, and providing the user with new and proper musical composition data based on evaluation results.

According to one aspect of the present invention, there is provided a server apparatus for providing musical composition data to an electronic musical apparatus, which is communicably connected to the server apparatus via a communication network, and which is operable by a user. The inventive server apparatus comprises a storage section that stores the musical composition data representing a plurality of musical compositions, a transmission section that transmits musical composition data which is stored in the storage section and which represents a first musical composition, to the electronic musical apparatus via the communication network in a streaming manner, such that the electronic musical apparatus can reproduce the first musical composition in realtime basis according to the transmitted musical composition data, a reception section that receives operation data from the electronic musical apparatus via the communication network, the operation data representing a user operation of the electronic musical apparatus performed in response to realtime reproduction of the first musical composition, and a control section that selects musical composition data representing a second musical composition from the storage section based on contents of the operation data received by the reception section, such that the second musical composition matches a skill of the user to operate the electronic musical apparatus, and that controls the transmission section to transmit the selected musical composition data of the second musical composition to the electronic musical apparatus in the streaming manner, whereby another user operation can be performed in response to the realtime reproduction of the second musical composition.

Further, there is provided a method of providing musical composition data to an electronic musical apparatus, which is communicably connected to the server apparatus via a communication network, and which is operable by a user. The inventive method comprises the steps of: storing the musical composition data representing a plurality of musical compositions; transmitting musical composition data which represents a first musical composition to the electronic musical apparatus via the communication network in a streaming manner, such that the electronic musical apparatus can reproduce the first musical composition in realtime basis according to the transmitted musical composition data; receiving operation data from the electronic musical apparatus via the communication network, the operation data representing a user operation of the electronic musical apparatus performed in response to realtime reproduction of the first musical composition; selecting musical composition data representing a second musical composition based on contents of the operation data, such that the second musical composition matches a skill of the user to operate the electronic musical apparatus; and transmitting the selected musical composition data of the second musical composition to the electronic musical apparatus in the streaming manner, whereby another user operation can be performed in response to the realtime reproduction of the second musical composition.

Preferably in the server apparatus according to the present invention, the transmission section transmits the musical composition data in the streaming manner together with control data which controls the electronic musical apparatus to store the transmitted musical composition data in a temporary memory of the electronic musical apparatus for the realtime reproduction of the musical composition, and which controls the electronic musical apparatus to delete the musical composition data from the temporary memory when the realtime reproduction of the musical composition terminates.

Preferably in the server apparatus according to the present invention, the control section selects the musical composition data representing a multiple of second musical compositions from the storage section based on contents of the operation data received by the reception section, and controls the transmission section to transmit a list of the multiple of the second musical compositions to the electronic musical apparatus for allowing the user to select a desired one of the second musical compositions.

Preferably in the server apparatus according to the present invention, the control section compares the contents of the operation data with the musical composition data of the first musical composition so as to evaluate the skill of the user to operate the electronic musical apparatus.

According to another aspect of the present invention, there is provided an electronic musical apparatus operable by a user for using musical composition data provided from a server apparatus communicably connected to the electronic musical apparatus via a communication network. The inventive electronic musical apparatus comprises a reception section that receives the musical composition data from the server apparatus in a streaming manner via the communication network, a storage section that temporarily stores the musical composition data received by the reception section, a reproduction section that reproduces the musical composition data temporarily stored in the storage section in realtime basis, a detection section that detects a user operation of the electronic musical apparatus performed in response to realtime reproduction of the musical composition data by the reproduction section, a transmission section that transmits operation data representing the user operation detected by the detection section to the server apparatus via the communication network, and a deletion section that deletes the musical composition data from the storage section when the realtime reproduction of the musical composition data terminates.

BRIEF DESCRIPTION OF THE DRAWINGS

FIG. 4 is a diagram exemplifying a musical performance skill versus musical composition correspondence table.

DETAILED DESCRIPTION OF THE INVENTION

[System Overview]

Figure 1:
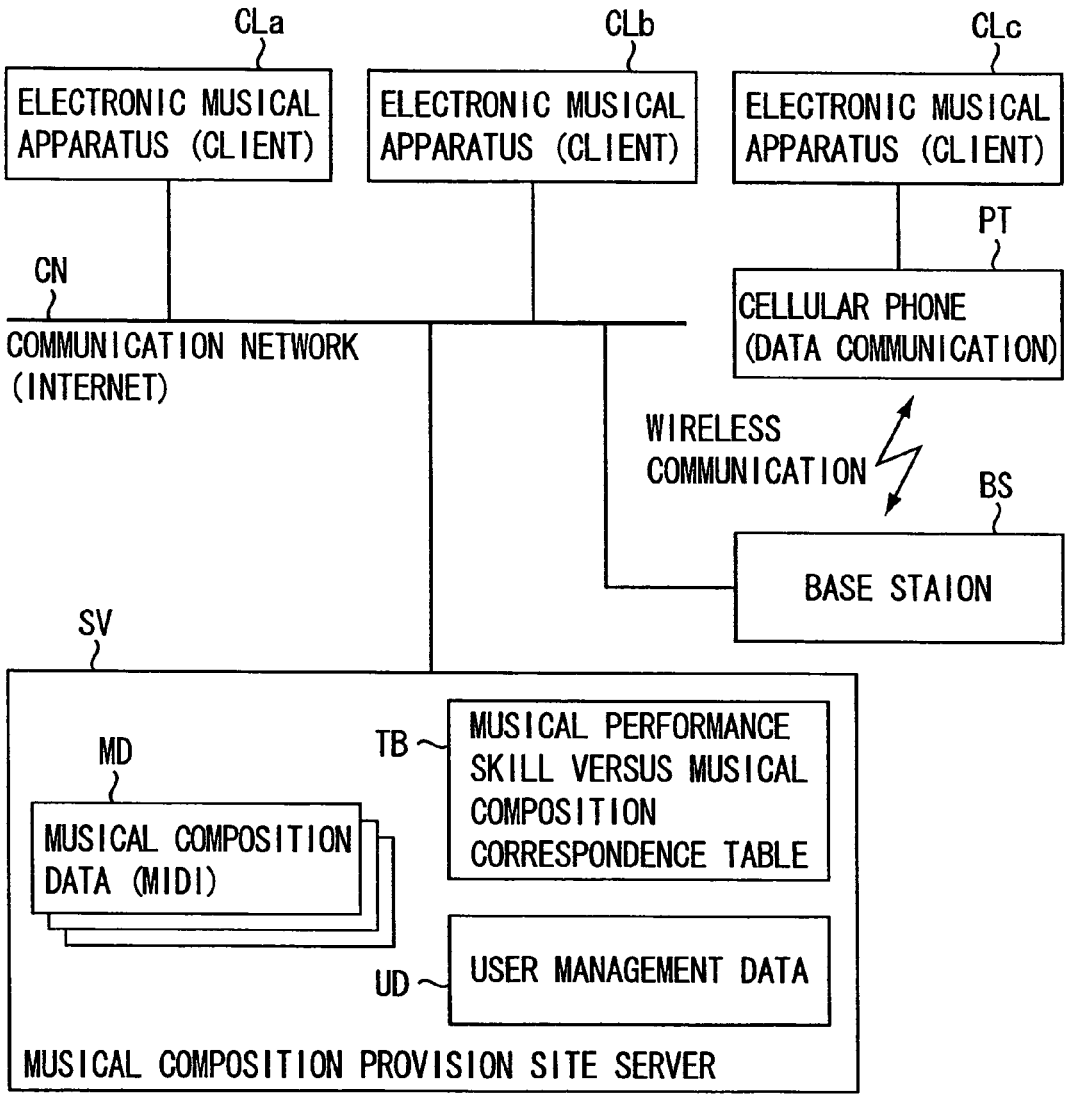
FIG. 1 is an overall construction diagram of a musical composition provision system according to an embodiment of the present invention.

FIG. 1 exemplifies the construction of an entire musical composition provision system according to an embodiment of the present invention. The musical composition provision system comprises a server apparatus SV and a plurality of electronic musical apparatuses CLa, CLb, CLc, and so on. The server apparatus SV functions as a musical composition data provision site. The electronic musical apparatuses can communicate with the server apparatus (SV) via a wide area communication network CN such as the Internet. In this example, the electronic musical apparatuses CLa, CLb, CLc, and so on work as clients (user terminals) for the server apparatus SV and comprise electronic musical instruments. A personal computer (PC) having a musical sound information processing capability may be used for each of the electronic musical apparatuses. The description to follow use a symbol "CL" to generally indicate such electronic musical apparatus (the electronic musical instrument or the PC).

The following concisely describes key points about the musical composition provision system with reference to FIG. 1. In this system, the server apparatus SV streams appropriate musical composition data (including phrases) to the electronic musical apparatus (electronic musical instrument) CL such as CLa, CLb, and so on via a communication network CN such as the Internet. The musical composition data is received in the electronic musical apparatus CL, is temporarily stored in temporary memory, and is used for reproduction. A user carries out musical performance operation (including game operation) in tune with reproduction of the musical composition data. A musical performance operation result is transmitted to the server apparatus SV. The musical composition data used for the reproduction is forcibly deleted from the temporary memory. Based on the user's operation result, the server apparatus SV transmits musical composition data corresponding to the user's operation skill as a new musical composition (candidate) for the musical performance operation to the electronic musical apparatus CL.

A more detailed description follows. A musical composition database MD is constructed in a large-capacity external storage device for the server apparatus SV. The database MD stores a large number of musical composition data in accordance with a specified format such as MIDI. Each musical composition data contains not only musical performance data to sequentially reproduce the musical composition itself, but also auxiliary data such as musical performance assistance information, musical score display support information, lyric information, game progress information, and video display information (image data).

Figure 2:
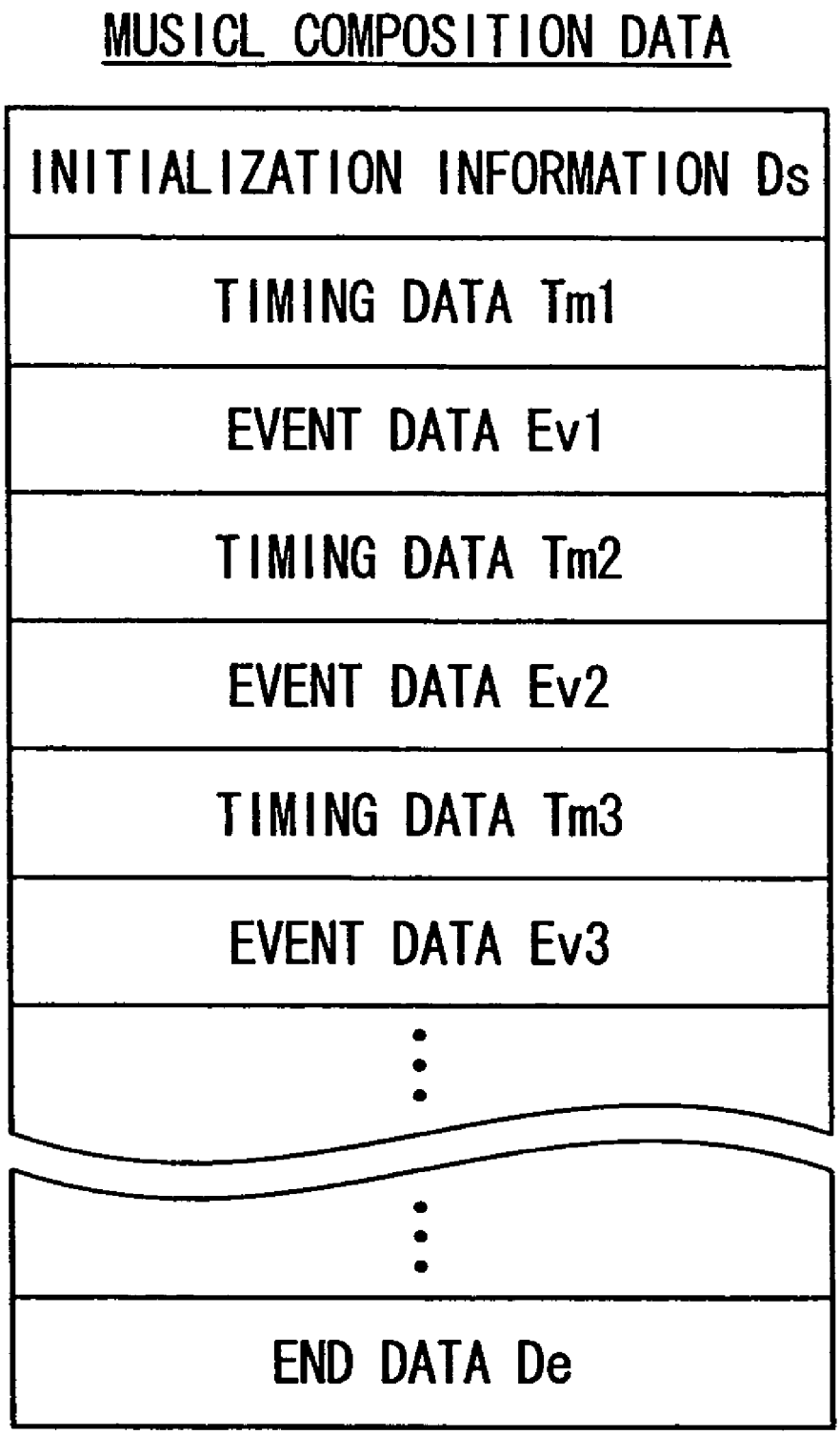
FIG. 2 is a diagram exemplifying the musical performance data constitution contained in musical composition data.

FIG. 2 concisely exemplifies the construction of musical performance data as main information of the musical composition data. The musical performance data is described in the conventional SMF (Standard MIDI File) format, for example. As shown in FIG. 2, the musical performance data begins with initialization information Ds followed by a chronological sequence of timing data Tm1, Tm2, and so on each followed by corresponding event data Ev1, Ev2, and so on, respectively. The musical performance data ends with end data De that indicates the end of musical performance.

The initialization information Ds records information to configure initial reproduction mode. Such information includes an initial timbre, volume, and tempo, for example. The event data Ev1, Ev2, and so on constitute musical performance event data that instructs a sound generating circuit 7 and a display circuit 6 (FIG. 3) to process various processes for musical composition reproduction. The event data includes note-on and note-off events to generate and mute musical notes, volume change, pitch change, and timbre change events to change the reproduction mode.

The external storage device of the server apparatus SV also stores a user management data file UD and a musical performance skill versus musical composition correspondence table TB. The user management data file UD is used for managing electronic musical instrument users registered in the musical composition provision system. The musical performance skill versus musical composition correspondence table TB is used for selecting musical compositions suitable for each user's musical performance skill.

Each electronic musical instrument CL may comprise the electronic musical instruments CLa and CLb having the communication capability. Alternatively, as shown on the top right of FIG. 1, the electronic musical instrument CL may comprise the electronic musical instrument CLc connected to a cellular phone PT. The latter (electronic musical instrument CLc) is connected to the communication network CN via the cellular phone PT and a wireless base station BS. The cellular phone PT is simply used as a wireless data communication interface. However, this construction is especially useful for handy type small-sized electronic musical instruments.

[Hardware Construction Example]

Figure 3:
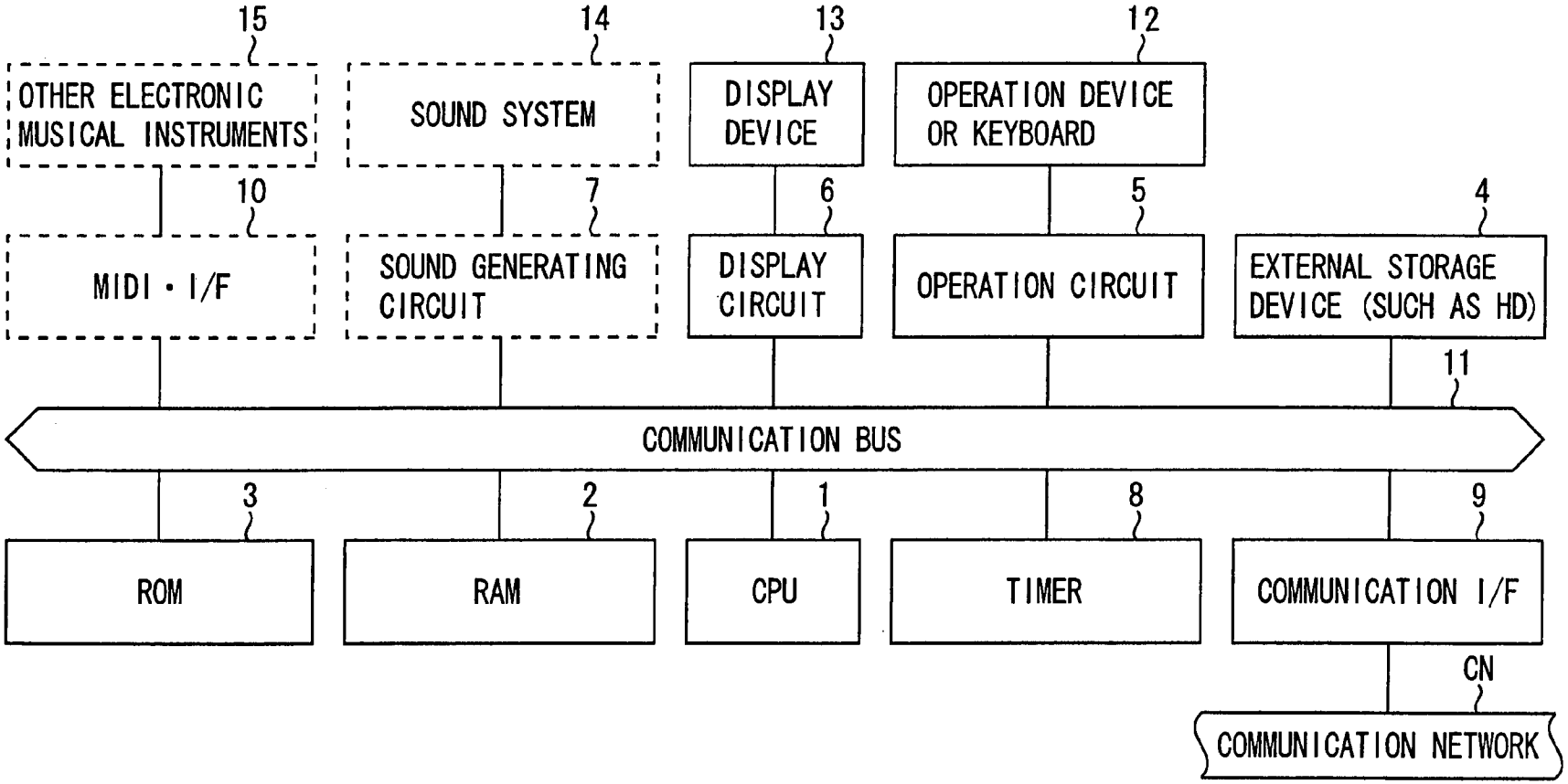
FIG. 3 is a hardware construction block diagram showing devices constituting the musical composition provision system according to an embodiment of the present invention.

FIG. 3 is a block diagram showing the hardware construction of devices constituting the musical composition provision system mainly with reference to the electronic musical apparatus CL. The following description assumes the electronic musical apparatus CL to be an electronic musical instrument, i.e., an information processor dedicated to musical composition information processing. As mentioned above, it may be preferable to use a general-purpose information processor such as a PC having musical sound information processing capabilities such as musical performance operation input, musical sound signal generation, and the like.

As shown in FIG. 3, the electronic musical instrument CL comprises a central processing unit (CPU) 1, volatile random access memory (RAM) 2, read-only memory (ROM) 3, an external storage device 4, an operation circuit 5, a display circuit 6, a sound generating circuit 7, a timer 8, a communication interface (communication I/F) 9, and a MIDI interface (I/F) 10. These devices 1 through 10 are connected to each other via a bus 11.

The CPU 1 follows a specified software program and uses clocks from the timer 8 to centrally provide control processes including musical composition data incorporation and various processes using such data. The RAM 2 is used as a work area to store data needed for various processes and the like. Further, the RAM 2 ensures a storage area used for temporary memory to temporarily store (i.e., for temporary storage of) musical composition data delivered from the server apparatus SV. The ROM 3 stores various control programs such as a musical composition data reproduction program and prepared musical composition data.

The external storage device 4 drives not only a hard disk (HD), but also portable storage media such as compact disk read-only memory (CD-ROM), a smart media magnetic optical (MO) disk, a flexible disk (FD), and a digital versatile disk (DVD). The external storage device 4 stores and saves various musical composition data and programs used by users. For example, the external storage device is provided with a musical composition data utilization file, making it possible to store programs and data needed for execution control using musical composition data. It may be preferable to provide the hard disk with the above-mentioned storage area for temporary memory.

The operation circuit 5 is connected to an operation section 12 including musical performance operation devices such as an instrumental keyboard and a wheel and panel operation devices such as a mouse and a keyboard. The operation circuit is used to detect contents of musical performance operations by means of the musical performance operation devices and setup operations by means of the panel operation devices and to supply the detected contents to the main system.

The display circuit 6 is connected to a display device 13 including a display and an indicator. The display circuit 6 controls the display device 13 in accordance with instructions from the CPU 1 to display operating states and setup contents of the electronic musical instrument CL on the display and provide display assistance to user operations on the operation section 12. Further, the display circuit 6 displays musical scores, key-press instructions, and game scenes on the display and turns on indicators in accordance with a key-press guide based on the musical composition data (not only musical performance data, but also auxiliary data such as musical score display support information, lyric information, and video display information) delivered from the server apparatus SV.

The sound generating circuit 7 is provided with an effect circuit including a sound source (including software) and a DSP (digital signal processor). The sound generating circuit 7 generates musical sound signals corresponding to musical performance operation information from the musical performance operation devices of the operation section 12 and musical performance data in the musical composition data from the storage section 2 through 4. A sound system 14 connected to the sound generating circuit 7 is provided with a D/A converter, an amplifier, and a speaker to generate musical sounds based on musical sound signals. The sound generating circuit 7 and the sound system 14 constitute musical sound output sections.

The communication I/F 9 is connected to the communication network CN such as the Internet and can communicate with the server apparatus SV via the network CN. The communication I/F 9 requests the server apparatus SV to deliver musical composition data for enabling the musical composition data to be streamed. Depending on types of the electronic musical instrument CL, the communication interface 9 comprises an interface connectable to the cellular phone PT. The cellular phone PT can communicate with the server apparatus SV via the base station BS using the wireless data communication. In this manner, musical composition data can be streamed likewise.

The MIDI I/F 10 connects with other electronic musical instruments (MIDI devices) 15, making it possible to interchange music information between the electronic musical apparatus CL and other electronic musical instruments 15.

In this system, the server apparatus SV contains a musical composition data delivery site capability to deliver musical composition data and is also referred to as the "musical composition provision site server". The hardware construction of the server apparatus SV is almost the same as that of the electronic musical instrument CL as shown in FIG. 3, but does not use the operation section and the operation circuit for musical performance operations. As indicated by broken lines, the musical sound output sections 7 and 14, the MIDI I/F 10, and the like may be omitted.

The server apparatus SV has the large-capacity external storage device (such as HD). As mentioned above, the external storage device (such as HD) 4 contains the musical composition database MD that stores many pieces of musical composition data. In addition, the external storage device 4 stores the user management data file UD for managing electronic musical instrument users and the musical performance skill versus musical composition correspondence table TB for selecting musical compositions suitable for each electronic musical instrument user's musical performance skill. The user management data file UD records identification information such as user IDs of electronic musical instrument users and device IDs of the corresponding electronic musical instruments. Further, the user management data file UD records evaluation data (most recent or log data) about musical performance operations with reference to the musical composition data provided by the server apparatus SV.

[Operation Overview]

In FIG. 1, the server apparatus SV responds to an access from the electronic musical instrument CL and transmits an HTML file and the like containing scripts (control data) corresponding to specified server-provided services. In response to this, the electronic musical instruments CLa, CLb, CLc, and so on activate network browsers to access the server apparatus SV to receive the HTML file and the like from the server apparatus SV. The electronic musical instruments can receive musical composition data and the like in the process of program steps according to the scripts (control data) contained in the HTML file and the like.

The first time the electronic musical instrument CL accesses the server apparatus SV, the electronic musical instrument CS transmits basic user information to the server apparatus SV. The basic user information is registered to the user management data file UD. The basic user information contains the electronic musical instrument user's user ID and the corresponding electronic musical instrument's device number. When the user registration allows the server apparatus SV to identify the user, the user management data file UD can record the user information needed to provide musical composition data.

The electronic musical instrument CL executes process functions according to scripts (control data) and the like in HTML files. The process functions include a streaming reception function (a streaming transmission function viewed from the server apparatus SV). When the electronic musical instrument CL accesses the server apparatus SV to receive musical composition data, the streaming reception function temporarily stores the received musical composition data in the RAM (temporary memory). Each time a reproduction process terminates, control is provided to delete the temporarily stored musical composition data at a time point when a service program terminates or when the electronic musical instrument is turned off (such time point being assumed to be termination of the streaming reception).

The electronic musical instrument CL executes a reproduction process based on the musical composition data that is acquired by streaming transmission from the server apparatus SV and is temporarily stored in the RAM (temporary memory). For example, the sound generating circuit 7 can be used to automatically play a specified part (e.g., an accompaniment part or a rhythm part) in the musical composition data. A musical score display function to concurrently use musical score display support information in the musical composition data can be used to display a musical score, a cursor to indicate the current position on the display device 13, and the like. Alternatively, a game execution function to concurrently use game progress information can be used to display musical game scenes.

During a reproduction process, the electronic musical instrument CL allows a user to control the musical performance operation in tune with the automatic play or musical score display. In addition, the electronic musical instrument CL temporarily stores results of user's musical performance operations in the RAM 2. When the musical performance operation terminates, the electronic musical instrument CL transmits a result of the musical performance operation to the server apparatus SV.

When the musical performance operation corresponds to performance practice, the server apparatus SV generates evaluation data that indicates the grading and evaluation of electronic musical instrument user's musical performance operations. Based on the grading and evaluation, the server apparatus SV references the musical performance skill versus musical composition correspondence table TB to create list information about practice-oriented musical compositions suitable for the electronic musical instrument user. The server apparatus SV transmits the evaluation data and the list information to the electronic musical instrument CL. FIG. 4 exemplifies the musical performance skill versus musical composition correspondence table TB. This example evaluates musical performance skills at five grades A through E in increments of 20 points, assuming "100 points" to be a perfect score.

When receiving the evaluation data and the list information, the electronic musical instrument CL allows the display device 13 to display the most recent practice-oriented musical composition name and practice-oriented musical composition names according to the list information. The user can select the displayed musical composition names. The electronic musical instrument CL transmits the user-selected musical composition name information to the server apparatus SV. In response to this, the server apparatus SV streams the musical composition data specified by the musical composition name information. This musical composition data can be used as the next etude.

For example, musical games may provide simple musical performance operations or processes. In such case, each electronic musical instrument CL itself may evaluate musical performance operations and transmit an evaluation result to the server apparatus SV. The electronic musical instrument CL can receive musical composition data corresponding to the evaluation result as streaming from the server apparatus SV.

[Process Flow Examples]

Figure 5:
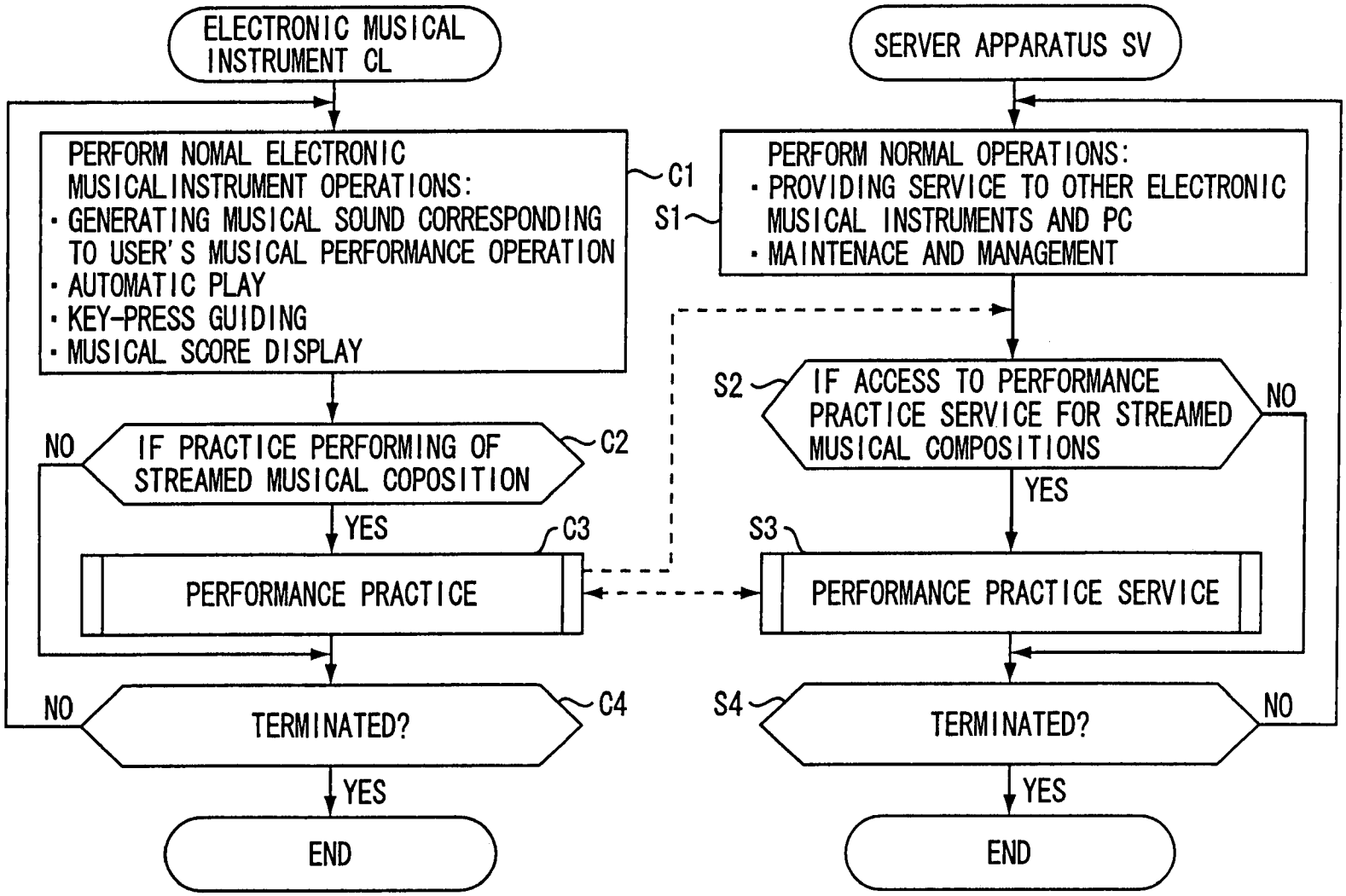
FIG. 5 is a flowchart exemplifying process operations (main process) of the overall musical composition provision system according to an embodiment of the present invention.

FIG. 5 is a flowchart exemplifying processes of the entire musical composition provision system according to the embodiment of the present invention. Normally, the electronic musical instrument (electronic musical apparatus) CL functions as an electronic musical instrument to perform specified operations (step C1). [Steps are hereafter represented with only reference symbols (C1 and the like).] When a user operates a musical performance operation device 12 on the operation section 12, for example, the system allows the musical sound output sections 7 and 14 to generate musical sounds corresponding to musical performance operations. Alternatively, the system provides automatic play or displays a key-press guide or a musical score based on the musical composition data recorded in the storage section 3 and 4.

When a specified timing is reached or a specified condition is satisfied, it is determined whether or not there is a user instruction to practice a streaming musical composition. When there is a user instruction for the performance practice (YES at C2), the system enters a performance practice stage (C3). At the performance practice stage, an electronic musical instrument user can receive a performance practice service from the server apparatus SV by streaming the musical composition data. At the same time, the user can enjoy specified musical performance operations.

When the performance practice stage (C3) terminates or when no performance practice instruction is issued (NO at C2), it is determined whether or not there is an instruction to terminate operations of the electronic musical instrument CL (C4). When there is no termination instruction (NO at C4), the system returns to step C1 and repeats the above-mentioned process operations (C1 through C3). When the termination instruction is issued (YES at C4), the system terminates operations of the electronic musical instrument CL.

On the other hand, the server apparatus SV normally performs specified server operations such as providing services for the other electronic musical instruments and PCs, maintaining the server itself, and controlling management operations. When a specified timing is reached or a specified condition is satisfied, it is determined whether or not the electronic musical instrument CL accesses the performance practice service for streaming musical compositions (S2). When this access occurs (YES at S2), a performance practice service stage is enabled. At the performance practice service stage, the electronic musical instrument user can use the specified electronic musical instrument CL to receive a specified performance practice service from the server apparatus SV by streaming musical composition data.

When the performance practice stage (S3) terminates or when the electronic musical instrument CL makes no access to the performance practice service (NO at S2), it is determined whether or not there is an instruction to terminate operations of the server apparatus SV (S4). When there is no termination instruction (NO at S4), the system returns to step S1 and repeats the above-mentioned process operations (S1 through S3). When the termination instruction is issued (YES at S4), the system terminates operations of the server apparatus SV.

At the performance practice stage (C3), the user of the electronic musical apparatus (electronic musical instrument) CL can be provided with streamed musical compositions from the server apparatus SV at the performance practice service stage (S3). He or she can enjoy musical performance operations as the performance practice or musical games. In the following description, a first embodiment [1] exemplifies "musical composition performance practice" mode for playing performance practices. A second embodiment [2] exemplifies "tone-guessing game" mode for playing a tone-guessing game as an example of games.

[1] FIRST EMBODIMENT

Figure 6:
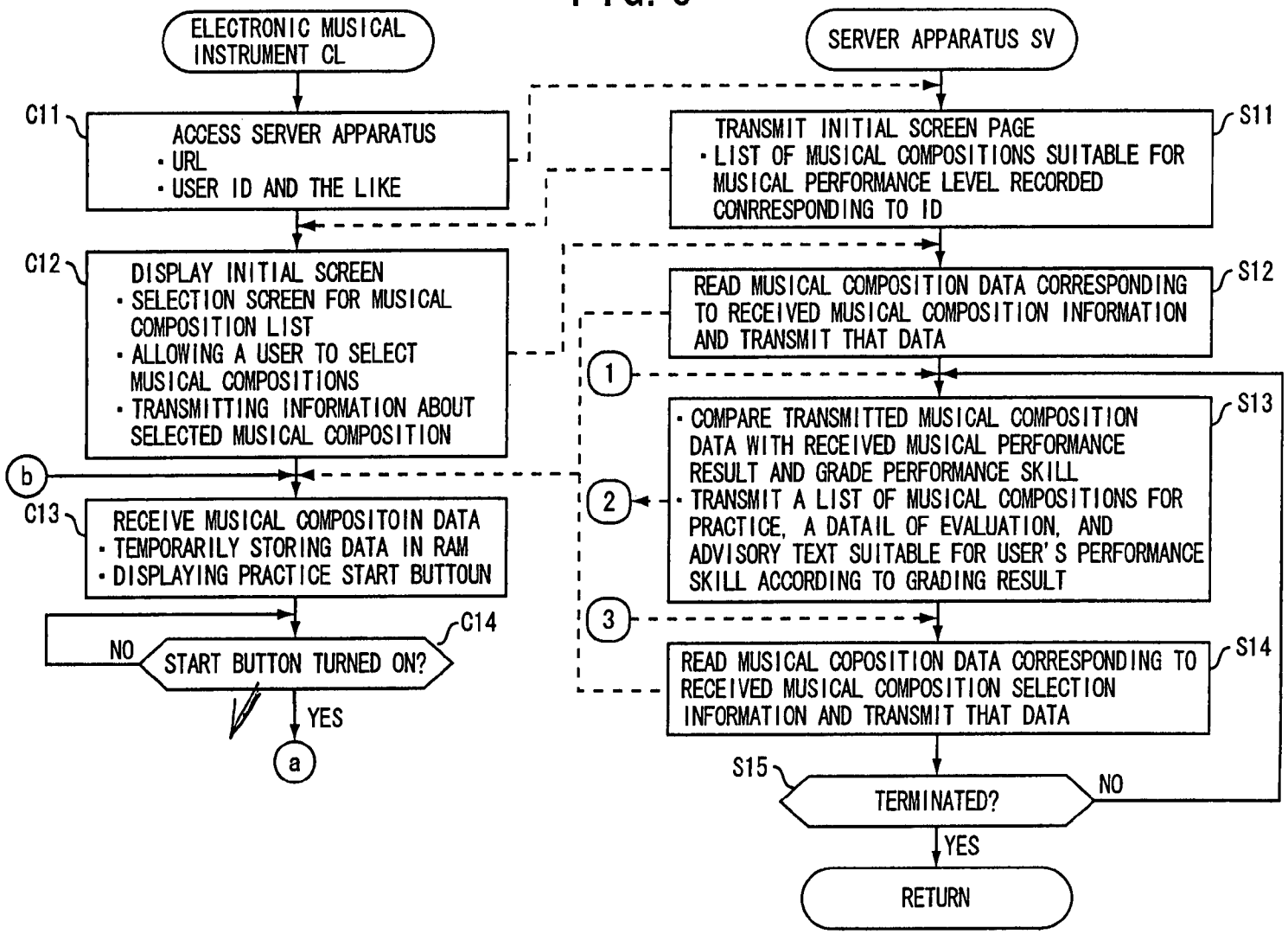
FIG. 6 is a part of a flowchart exemplifying process operations in "musical composition performance practice" mode according to an embodiment of the present invention.
Figure 7:
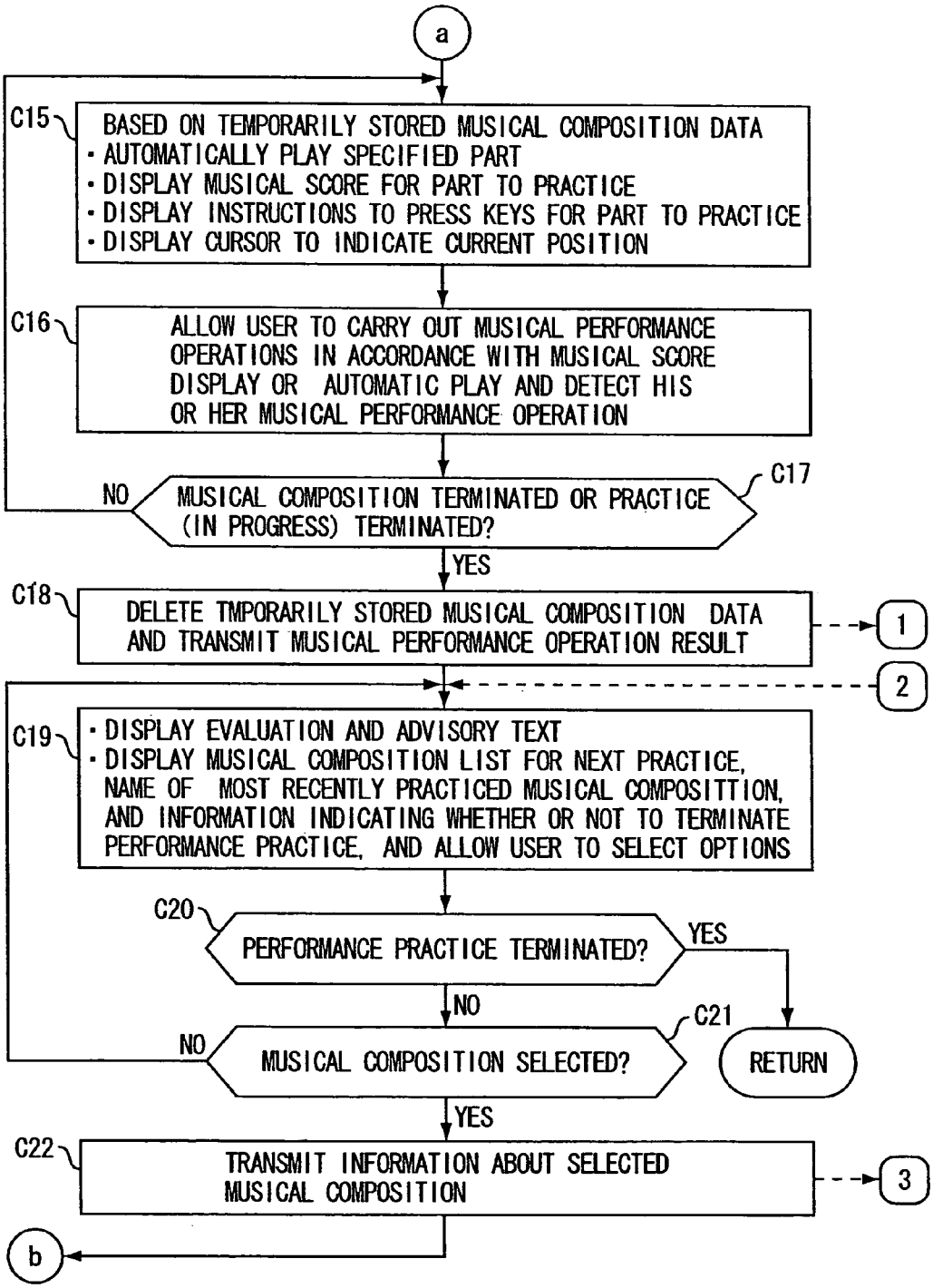
FIG. 7 is another part of the flowchart exemplifying the process operations in "musical composition performance practice" mode according to an embodiment of the present invention.

FIGS. 6 and 7 are flowcharts exemplifying process operations in the "musical composition performance practice" according to an embodiment of the present invention. When entering the performance practice stage (C3 in FIG. 5), the electronic musical instrument CL operates in the "musical composition performance practice" mode according to a user operation to specify the practice mode. Further, the electronic musical instrument CL specifies a "musical composition performance practice" mode URL for the server to access the server apparatus SV, and then transmits necessary user information such as the user ID (C11).

In response to this (YES at S2 in FIG. 5), the server apparatus SV enters the performance practice service stage (C3) to operate in the "musical composition performance practice" mode. The server apparatus SV transmits initial screen page information to the electronic musical instrument CL (S11). That is, based on the user ID, the server apparatus SV extracts the most recent musical performance evaluation recorded in the user management data file UD. The musical composition list contains musical composition data stored in the musical composition database MD. From this musical composition list, the server apparatus SV selects a musical composition suitable for the electronic musical instrument user's musical performance evaluation (musical performance skill). The server apparatus SV transmits the initial screen page information that lists item information about the musical compositions.

In accordance with the received initial screen page information, the electronic musical instrument CL displays an initial screen on the display 13 (C12). The initial screen provides a list of musical compositions selectable and available for the electronic musical instrument. When the user operates this screen to select an intended musical composition, the electronic musical instrument CL transmits the information about the selected musical composition to the server apparatus SV.

The server apparatus SV reads musical composition data corresponding to the received musical composition information from the external storage device (HD) 4 and transmits that data (S13). The electronic musical instrument CL receives the musical composition data and temporarily stores it in the RAM 2 as temporary memory. Further, the electronic musical instrument CL uses the display 13 to display a performance practice screen for the musical composition data containing a practice start button (C13). The electronic musical instrument CL determines whether or not the user turns on the practice start button displayed on the screen (C14).

When the user does not turn on the practice start button (NO at C14), the electronic musical instrument CL waits for a user operation. When the user operates the practice start button to start the performance practice (YES at C14), the electronic musical instrument CL proceeds to the step (step C15 in FIG. 7) to reproduce the musical composition data. The electronic musical instrument CL performs reproduction processes based on the musical composition data temporarily stored in the temporary memory.

For example, the electronic musical instrument CL performs the following reproduction processes. The electronic musical instrument CL allows the musical sound output sections 7 and 14 to automatically play a specified part (e.g., a rhythm or accompaniment part when practicing a melody part) of the musical performance data contained in the musical composition data. The electronic musical instrument CL allows the display 13 to display the musical score of a part to practice (e.g., a melody part when practicing it). The electronic musical instrument CL displays a screen or indicators to instruct keys to be pressed for the part to practice. When displaying a musical score or a musical note character, the electronic musical instrument CL moves and displays a cursor in accordance with the current position.

Further, the electronic musical instrument CL allows the user to carry out the musical performance operations in accordance with the musical score display or the automatic play. The electronic musical instrument CL reads the contents of the musical performance operations and sequentially stores them in a specified area of the RAM 2. When a specified timing is reached or a specified condition is satisfied, the electronic musical instrument CL determines whether or not the musical composition data reproduction process or the performance practice terminates (C17). (The musical composition data reproduction process or the performance practice may terminate in the middle of the reproduction process including an operation of a musical performance operation stop button.) While the musical composition data reproduction process or the performance practice takes effect (NO at C17), the electronic musical instrument CL returns to the reproduction step (C15) to repeat the reproduction process and the musical performance operation detection (C15 and C16).

When the musical composition data reproduction or the performance practice (even though not complete) terminates (YES at C17), the electronic musical instrument CL deletes the musical composition data temporarily stored in the temporary memory. In addition, the electronic musical instrument CL transmits the musical performance operation result data stored in the specified area of the RAM 2 to the server apparatus SV (C18). Further, the electronic musical instrument CL uses the musical composition data utilization file on the external storage device 4 to record that the performance practice of the musical composition data is complete.

The server apparatus SV evaluates the musical performance operation result data received from the electronic musical instrument CL (S13). That is, the server apparatus SV grades the musical performance operation result data by comparing it to the most recently transmitted musical composition data. The server apparatus SV references the musical performance skill versus musical composition correspondence table TB and evaluates the electronic musical instrument user's musical performance skill according to a grading result. Corresponding to this evaluation, the server apparatus SV selects practice-oriented musical compositions and list information about them. In addition, the server apparatus server apparatus SV creates evaluation data that represents an evaluation grade (A through E) and advisory text. The server apparatus SV transmits the created musical composition list information and evaluation data to the electronic musical instrument CL. The necessary evaluation data containing the evaluation grade is updated and recorded in the user management data file UD.

When receiving the musical composition list information and the evaluation data, the electronic musical instrument CL uses the display 13 to display the necessary information according to the received data (C19). For example, the electronic musical instrument CL displays the evaluation grade and the advisory text in accordance with the evaluation data. Alternatively, the electronic musical instrument CL uses the musical composition list information to display a musical composition list for the next practice. The musical composition list contains the most recent practice-oriented musical composition name. Each musical composition is appended with user-provided information needed to select musical compositions. Such information indicates whether or not the performance practice is complete, for example. This makes it possible to allow the user to select the musical composition to practice.

The electronic musical instrument CL then determines whether or not an instruction is issued to terminate the performance practice (C20). When there is no such instruction (NO at C20), the electronic musical instrument CL further determines whether or not an instruction is issued to select a musical composition (C21). When there is no instruction to select musical compositions (NO at C21), the electronic musical instrument CL returns to the step (C19) to display the necessary information and prompts the user to select a musical composition. The electronic musical instrument CL repeats the termination determination or the musical composition selection (C20 or C21). The user may carry out an operation to select a musical composition from the musical composition list (YES at C21). In this case, the electronic musical instrument CL transmits the information about the selected musical composition to the server apparatus SV (C22) and then returns to the reproduction step (C15).

The server apparatus SV receives information about the musical composition selected on the electronic musical instrument CL. In this case, the server apparatus SV reads musical composition data corresponding to the information about the received selected musical composition from the musical composition database in the external storage device (HD) and transmits the musical composition data to the electronic musical instrument CL (S14).

The electronic musical instrument CL reproduces musical composition data newly transmitted at the reproduction step (C15) and the like. While data is transmitted from the server apparatus SV in this manner, the electronic musical instrument CL repeats the above-mentioned process operations (C15 through C22). An instruction may be issued to terminate the performance practice at the termination determination step (YES at C20). In this case, the electronic musical instrument CL terminates the performance practice stage in the "musical composition performance practice" mode and returns to step C4 of the main process (FIG. 5).

After transmitting the musical composition data (S14), the server apparatus SV determines whether or not an instruction is issued to the electronic musical instrument CL to terminate the performance practice service (S15). When there is no instruction (NO at S15), the server apparatus SV returns to the step (S13) to evaluate the musical performance operation evaluation. While data is transmitted from the electronic musical instrument CL, the server apparatus SV repeats the processes to evaluate the musical performance operation result and transmit the selected musical composition (S13 and S15). When a termination instruction is issued (YES at S15), the server apparatus SV terminates the performance practice service in the "musical composition performance practice" mode and returns to step S4 of the main process (FIG. 5).

[2] SECOND EMBODIMENT

Figure 8:
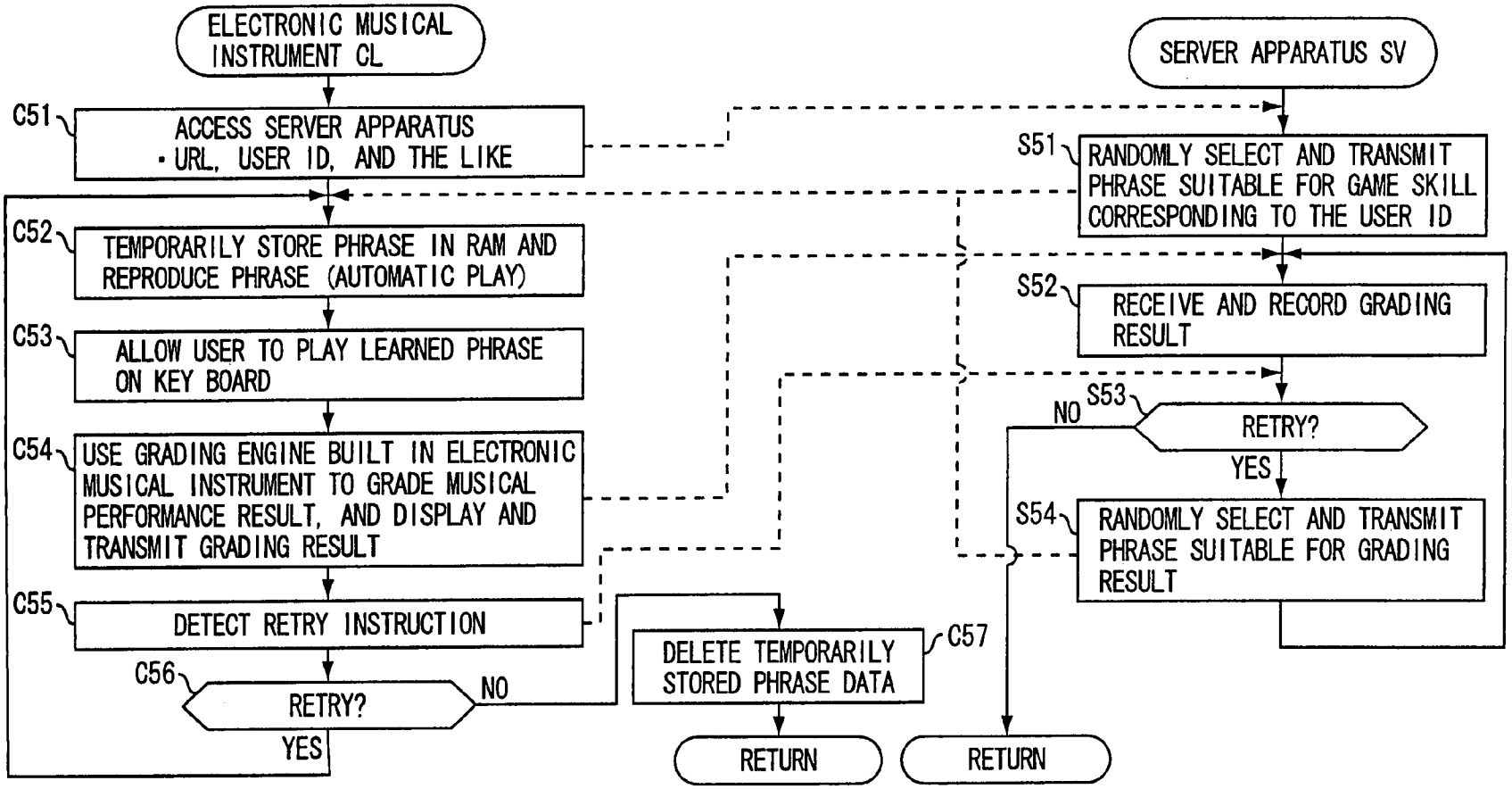
FIG. 8 is a flowchart exemplifying process operations in "tone-guessing game" mode according to an embodiment of the present invention.

FIG. 8 is a flowchart exemplifying process operations in "tone-guessing game" mode according to an embodiment of the present invention. When entering the performance practice stage (C3 in FIG. 5), the electronic musical instrument CL operates in the "tone-guessing game" mode according to a user operation to specify the game mode. Further, the electronic musical instrument CL specifies a server's "tone-guessing game" mode URL to access the server apparatus SV and transmits necessary user information such as the user ID (C51).

In response to this (YES at S2 in FIG. 5), the server apparatus SV enters the performance practice service stage (C3) to operate in the "tone-guessing game" mode. The server apparatus SV transmits phrase data suitable for a game skill corresponding to the user ID (S51). Based on the user ID, the server apparatus SV extracts the most recent musical performance evaluation recorded in the user management data file UD. There is provided a musical composition phrase list of musical composition data stored in the musical composition database MD. From this list, the server apparatus SV selects phrase data of musical compositions suitable for the electronic musical instrument user's musical performance evaluation (game skill). The server apparatus SV then randomly selects one of these phrase data and transmits it to the electronic musical instrument CL.

The electronic musical instrument CL receives the phrase from the server apparatus SV, temporarily stores the received phrase in the RAM 2 as temporary memory, and reproduces (automatically plays) the phrase data using the musical sound output sections 7 and 14 (C52). Further, the electronic musical instrument CL allows the user to play the learned phrase reproducing tones on the musical performance operation device (e.g., keyboard). The electronic musical instrument CL detects the contents of the musical performance operation and stores them in a specified area of the RAM 2 (C53).

When terminating the phrase reproduction, the electronic musical instrument CL uses its built-in grading engine (e.g., stored in the musical composition data utilization file on the external storage device 4) to grade the musical performance result stored in the RAM 2. The electronic musical instrument CL displays a grading result and transmits it to the server apparatus SV (C54). The electronic musical instrument CL detects whether or not the user operation issues an instruction to continue or terminate (i.e., retry or decline) the game. The electronic musical instrument CL transmits retry (continuation) control information indicating the instruction content to the server apparatus SV (C55). At the same time, the electronic musical instrument CL determines the instruction content (C56).

When the user issues an instruction to continue or retry the game (YES at C56), the electronic musical instrument CL returns to the step (C52) to receive the phrase. While data is transmitted from the server apparatus SV, the electronic musical instrument CL repeats the above-mentioned process operations (C52 through C55). When there is found an instruction to terminate the game at the step to determine the retry (NO at C56), the electronic musical instrument CL deletes the phrase data temporarily stored in the temporary memory (C57). The electronic musical instrument CL terminates the performance practice stage in the "tone-guessing game" mode and returns to step C4 of the main process (FIG. 5).

The server apparatus SV receives a grading result from the electronic musical instrument CL and records it in an entry for the electronic musical instrument user in the user management data file (S52). Further, the server apparatus SV receives the retry (continuation) control information and determines whether or not the information indicates retry (S53). When the retry is selected (YES at S53), the server apparatus SV randomly selects a phrase suitable for the grading result and transmits it to the electronic musical instrument CL (C54). The server apparatus SV then returns to the step (S52) to receive a grading result. While phrase data is transmitted from the electronic musical instrument CL, the server apparatus SV repeats the above-mentioned operations (S52 through S54).

The retry (continuation) control information from the electronic musical instrument CL may instruct termination of the game (NO at S53). In this case, the server apparatus SV terminates the performance practice service stage in the "tone-guessing game" mode and returns to step S4 of the main process (FIG. 5).

[Various Modes]

While there have been described the preferred embodiments of the present invention, they are only examples. various changes may be made in the present invention without departing from the spirit and scope thereof. The present invention can be embodied in various modes. According to the second embodiment (FIG. 8), for example, the musical composition data (phrase) is deleted at the termination of the "tone-guessing game" (C57). It may be preferable to delete musical composition data each time an evaluation result is transmitted (C54).

The above-mentioned embodiments use the RAM 2 to ensure an area to temporarily store musical composition data or phrase data supplied from the server. The temporary storage area may be ensured on the external storage device such as a hard disk (HD) capable of reading and writing.

The temporary storage area may be monitored at the other timings than those described in the embodiments such as timing to turn on the power or initiate the software, at a specified cycle during software execution, and the like. The temporary storage area may be so constructed as to delete data that is not processed currently. This constitution helps to ensure the temporary storage area in the nonvolatile RAM or the external storage device (such as an HD) 4. Even though an error occurs to unsuccessfully complete the process to delete data, it is possible to execute the process to delete data at the next timing to turn on the power or initiate the software or at the next timing according to the specified cycle.

According to the embodiments, the server apparatus SV controls the use of musical composition data according to HTML files containing scripts (control data) and the like. Further, the server apparatus may preinstall a musical composition data utilization program (control data) exclusively used for the electronic musical apparatus (electronic musical instrument). Thereafter, it may be preferable to receive musical composition data from the server apparatus by means of streaming in accordance with the musical composition data utilization program.

As described above, according to one aspect of the present invention, there is provided a server apparatus (SV) for streaming musical composition data to an electronic musical apparatus (CL) communicably connected via a communication network (CN). The server apparatus is provided with a storage section (4; MD) for storing a plurality of pieces of musical composition data, a transmission section (9; S3: S11 through S14; S51, S54) for streaming musical composition data stored in the storage section (4; MD) to an electronic musical apparatus (CL), a reception section (9; S3: S13, S14; S52) for receiving operation data from the electronic musical apparatus (CL), wherein the operation data represents an electronic musical apparatus user's operation result responsive to reproduction of streamed musical composition data, a control section (S3: S13, S14; S52 through S54) for selecting musical composition data corresponding to the electronic musical apparatus user's operation skill out of musical composition data stored in the storage section (4; MD) based on the contents of operation data received by the reception section (S13; S52) and allowing the transmission section (S14; S54) to stream selected musical composition data to the electronic musical apparatus (CL)

In the streaming provision server apparatus (SV) according to the present invention, when the electronic musical apparatus (CL) receives the musical composition data, the transmission section (9; S3) transmits control data for storing the musical composition data in a temporary memory (2, 4) of the electronic musical apparatus (CL) and deleting the musical composition data from the temporary memory (2, 4) when reproduction of the musical composition data terminates.

In the streaming provision server apparatus (SV) according to the present invention, the control section (S13, S14; S52 through S54) can be constructed to select a plurality of musical compositions corresponding to the electronic musical apparatus user's operation skill based on the contents of the operation data received by the reception section (S13, S14; S52) and allow the transmission section (S14; S54) to transmit a list of the selected musical compositions.

In the streaming provision server apparatus (SV) according to the present invention, the control section (S13, S14; S52 through S54) can be constructed to compare the operation data with the corresponding musical composition data and evaluate the electronic musical apparatus user's operation skill.

According to another aspect of the present invention, there is provided an electronic musical apparatus (CL) using musical composition data streamed from a server apparatus (SV) communicably connected via a communication network (CN). The inventive electronic musical apparatus is provided with a reception section (9; C3: C12, C13, C19; C52) for receiving musical composition data streamed from a server apparatus (SV), a storage section (2, 4: C13; C52) for temporarily storing streamed musical composition data received by the reception section (C13; C52), a reproduction section (C3: C15; C52) for reproducing musical composition data temporarily stored in the storage section (2, 4), a detection section (C16; C54) for detecting a user operation responsive to reproduction of the musical composition data by means of the reproduction section (C15; C52), a transmission section (9; C3: C11, C12, C18, C22; C51, C54, C55) for transmitting operation data to the server apparatus (SV), wherein the operation data represents a user operation detected by the detection section (C16; C54), and a deletion section (C3: C18; C57) for deleting the musical composition data from the storage section (2, 4) when reproduction of the musical composition data terminates.

In the musical composition provision system according to the present invention, the server apparatus (SV) can interchange data with the electronic musical apparatus (CL) such as an electronic musical instrument via the communication network (CN) such as the Internet using the communication section (9). The server apparatus has the storage section (4) for storing a plurality of musical composition data and can stream musical composition data appropriate to the electronic musical instrument (CL).

When the server apparatus (SV) streams musical composition data to the electronic musical instrument (CL), the electronic musical instrument (CL) performs a reproduction process based on the streamed musical composition data (C15; C52). The reproduction process includes not only an automatic play function to automatically play necessary parts of musical performance data in the musical composition data, but also a key-press assisting or guiding function and a musical score display function according to musical performance assisting information and musical score display support information contained in the musical composition data. Alternatively, the reproduction process may include a game function (e.g., displaying a musical score or a game scene correspondingly to musical composition data) according to game progress information contained in the musical composition data. The sound may or may not be generated.

Let us suppose that a user of the electronic musical instrument (CL) carries out specified musical performance operations including game operations in response to the reproduction of the musical composition data. The electronic musical instrument (CL) detects the user operations and generates operation data representing a result of the musical performance operations (including a grading result of the game operation and the like). The electronic musical instrument (CL) then transmits the generated operation data to the server apparatus (SV). Based on the user operation result represented by the received operation data, the server apparatus (SV) selects one of the musical composition data appropriate for the electronic musical apparatus user's operation skill out of the plurality of the musical composition data stored in the storage section (9). The server apparatus (SV) then transmits the selected musical composition data as a musical composition for the next user operation to the electronic musical instrument (CL).

Therefore, the present invention can allow an electronic musical apparatus user to carry out a specified musical performance operation in accordance with reproduction of musical composition data streamed from the server apparatus. In addition, the present invention can evaluate user's musical performance operations and provides the electronic musical apparatus user with appropriate, new musical composition data based on the evaluation result.

Prior to or simultaneously with transmission of the musical composition data from the server apparatus (SV), the musical composition provision system according to the present invention transmits control data or a control program concerning the usage of musical composition data supplied from the server apparatus (SV) to the electronic musical instrument (CL). In accordance with the control data (control program), the electronic musical instrument (CL) temporarily stores the received musical composition data as a file in the storage section (2, 4) called temporary memory. When reproduction of the musical composition data terminates, the electronic musical instrument (CL) assumes this to be "termination of streaming reception" and deletes the musical composition data from the temporary memory (2,4). For example, "termination of streaming reception" occurs each time the musical composition data reproduction process terminates, or when a musical composition data service program terminates, or when the electronic musical instrument (CL) is turned off.

That is, the present invention artificially provides so-called "streaming" in such a manner as to provide streamed musical composition data (to transmit it from the server apparatus) or use it (to receive it at the electronic musical apparatus). Specifically, the musical composition data is temporarily stored in the temporary memory of the electronic musical apparatus. When there becomes no need to use the stored musical composition data, it is forcibly deleted from the temporary memory. Accordingly, the present invention can continuously reproduce musical composition data by artificially performing the streaming.

In the musical composition provision system according to the present invention, the server apparatus (SV) receives a musical performance operation result from the electronic musical instrument (CL), and then streams next musical composition data. At this time, the server apparatus (SV) once delivers a list of one or more musical compositions matching the electronic musical apparatus user's musical performance operation skill. The server apparatus (SV) allows the user to select desired musical compositions including the musical composition apt to the most recent musical performance operation. The server apparatus (SV) transmits musical composition data of the selected musical composition as the next program to the electronic musical instrument (CL).

Therefore, according to the present invention, the electronic musical apparatus user can select a desired musical composition out of new (one or more) musical compositions suitable for the user and apt to the most recently practiced musical performance. It is possible to broaden the range of user-selectable musical compositions and promote the user's will for practice.

The musical composition provision system according to the present invention transmits a result of musical performance operations carried out with the electronic musical apparatus from the electronic musical instrument (CL) to the server apparatus (SV). The server apparatus (SV) compares the result with the corresponding musical composition data to grade and evaluate the result.

Since the present invention provides the server apparatus with the grading and evaluation function, it is possible to alleviate process loads on the electronic musical apparatus such as an electronic musical instrument. Providing the server with the grading and evaluation function can centralize processes in the entire system. This is much more efficient than providing the grading and evaluation function for each of electronic musical apparatuses.

What is claimed is:

1. A server apparatus for providing musical composition data to an electronic musical apparatus, which is communicably connected to the server apparatus via a communication network, and which is operable by a user, the server apparatus comprising:

a storage section that stores the musical composition data representing a plurality of musical compositions;

a transmission section that transmits musical composition data which is stored in the storage section and which represents a first musical composition, to the electronic musical apparatus via the communication network in a streaming manner, such that the electronic musical apparatus can reproduce the first musical composition in realtime basis according to the transmitted musical composition data;

a reception section that receives operation data from the electronic musical apparatus via the communication network, the operation data representing a user operation of the electronic musical apparatus performed in response to realtime reproduction of the first musical composition; and a control section that selects musical composition data representing a second musical composition from the storage section based on contents of the operation data received by the reception section, such that the second musical composition matches a skill of the user to operate the electronic musical apparatus, and that controls the transmission section to transmit the selected musical composition data of the second musical composition to the electronic musical apparatus in the streaming manner, whereby another user operation can be performed in response to the realtime reproduction of the second musical composition.

2. The server apparatus according to claim 1, wherein the transmission section transmits the musical composition data in the streaming manner together with control data which controls the electronic musical apparatus to store the transmitted musical composition data in a temporary memory of the electronic musical apparatus for the realtime reproduction of the musical composition, and which controls the electronic musical apparatus to delete the musical composition data from the temporary memory when the realtime reproduction of the musical composition terminates.

3. The server apparatus according to claim 1, wherein the control section selects the musical composition data representing a multiple of second musical compositions from the storage section based on contents of the operation data received by the reception section, and controls the transmission section to transmit a list of the multiple of the second musical compositions to the electronic musical apparatus for allowing the user to select a desired one of the second musical compositions.

4. The server apparatus according to claim 1, wherein the control section compares the contents of the operation data with the musical composition data of the first musical composition so as to evaluate the skill of the user to operate the electronic musical apparatus.

5. A method of providing musical composition data to an electronic musical apparatus, which is communicably connected to the server apparatus via a communication network, and which is operable by a user, the method comprising the steps of:

storing the musical composition data representing a plurality of musical compositions;

transmitting musical composition data which represents a first musical composition to the electronic musical apparatus via the communication network in a streaming manner, such that the electronic musical apparatus can reproduce the first musical composition in realtime basis according to the transmitted musical composition data;

receiving operation data from the electronic musical apparatus via the communication network, the operation data representing a user operation of the electronic musical apparatus performed in response to realtime reproduction of the first musical composition;

selecting musical composition data representing a second musical composition based on contents of the operation data, such that the second musical composition matches a skill of the user to operate the electronic musical apparatus; and transmitting the selected musical composition data of the second musical composition to the electronic musical apparatus in the streaming manner, whereby another user operation can be performed in response to the realtime reproduction of the second musical composition.

6. An electronic musical apparatus operable by a user for using musical composition data provided from a server apparatus communicably connected to the electronic musical apparatus via a communication network, the electronic musical apparatus comprising:

a reception section that receives the musical composition data from the server apparatus in a streaming manner via the communication network;

a storage section that temporarily stores the musical composition data received by the reception section;

a reproduction section that reproduces the musical composition data temporarily stored in the storage section in realtime basis;

a detection section that detects a user operation of the electronic musical apparatus performed in response to realtime reproduction of the musical composition data by the reproduction section;

a transmission section that transmits operation data representing the user operation detected by the detection section to the server apparatus via the communication network; and a deletion section that deletes the musical composition data from the storage section when the realtime reproduction of the musical composition data terminates.

* * * * *